US005238168A

United States Patent [19]

Oda

[11] Patent Number: 5,238,168

[45] Date of Patent: Aug. 24, 1993

[54] MECHANISM FOR REMOVING JAMMED FASTENER IN FASTENER DRIVING DEVICE

[75] Inventor: Jiro Oda, Anjo, Japan

[73] Assignee: Makita Corporation, Anjo, Japan

[21] Appl. No.: 899,994

[22] Filed: Jun. 17, 1992

[30] Foreign Application Priority Data

Jun. 21, 1991 [JP] Japan ..... 3-055688

[51] Int. Cl.[5] ..... B25C 1/04

[52] U.S. Cl. ..... 227/123; 227/130

[58] Field of Search ..... 227/123, 130

[56] References Cited

U.S. PATENT DOCUMENTS

| | | | |
|---|---|---|---|
| 3,099,012 | 7/1963 | Wandel | 227/123 |
| 3,107,584 | 10/1963 | Powers | 227/123 X |
| 3,578,231 | 5/1971 | Novak | 227/123 |
| 3,934,778 | 1/1976 | Males | 227/123 |
| 3,957,192 | 5/1976 | Fehrs | 227/123 |
| 4,211,352 | 7/1980 | Zilka | 227/130 |
| 4,467,952 | 8/1984 | Morrell, Jr. | 227/123 |
| 4,641,772 | 2/1987 | Skuthan | 227/123 |

FOREIGN PATENT DOCUMENTS

| | | |
|---|---|---|
| 43357 | 3/1964 | Japan . |
| 60-61179 | 4/1985 | Japan . |
| 60-125078 | 8/1985 | Japan . |

*Primary Examiner*—Frank T. Yost
*Assistant Examiner*—Rinaldi Rada
*Attorney, Agent, or Firm*—Dennison, Meserole, Pollack & Scheiner

[57] ABSTRACT

A mechanism is provided for removing a jammed fastener from a fastener drive track formed in a driver guide of a fastener driving device through an opening formed in the fastener dive track. The fastener driving device includes a driver reciprocally driven by a driving source to drive fasteners fed into the fastener drive track. The mechanism for removing the jammed fastener includes a movable member for closing the opening of the fastener drive track. A connecting mechanism connects the movable member to the drive guide to such a manner that the movable member is movable relative to the drive guide between a first position for closing the opening and a second position for opening the opening. An engaging mechanism is provided for engaging the movable member with the driver guide so as to keep the movable member at the first position. A first biasing mechanism biases the movable member in a direction to engage the same with the driver guide. The first biasing mechanism applies a biasing force to the movable member when the driver is driven by the driving source, while it is prevented from applying the biasing force to the movable member when the driver is not driven.

9 Claims, 3 Drawing Sheets

MECHANISM FOR REMOVING JAMMED FASTENER IN FASTENER DRIVING DEVICE

BACKGROUND OF THE INVENTION

1. Field of the Invention

The present invention relates to a mechanism for removing a jammed fastener from a fastener drive track formed in a driver guide of a fastener driving device.

2. Description of the Prior Art

A conventional fastener driving device includes a driver guide having therein a fastener drive track through which a driver is reciprocally moved for ejecting fasteners one after another. A mechanism is provided for removing a fastener which has been jammed in the fastener drive track and which cannot be driven by the driver.

Japanese Laid-Open Utility Model Publication Nos. 60-125078 and 60-61179 disclose a mechanism having a guide member forming a part of a driver guide. The guide member is pivotable relative to the drive guide or is detachable from the driver guide. A fastener jammed within a fastener drive track can be removed by pivotally moving the guide member or by removing the same from the driver guide.

Japanese Patent Publication No. 43-457 discloses a mechanism having a guide member forming apart of a driver guide. When a fastener has been jammed within a fastener drive track formed in the driver guide, the guide member is moved open the fastener guide track by a strong force produced by the jammed fastener.

However, with the above conventional mechanisms, an operator can manually move the guide member to open or close the fastener drive track during driving operation of a driver. For example, in case that these mechanism have been applied to a pneumatic fastener driving device which is drive by compressed air as a drive source, a problem is caused that the driver may be driven through activation of a trigger valve when the operator is manually moving the guide member from the closing position to the opening position or vice versa.

Further, the guide member is required to be held at the closing position during driving operation, and the guide member is held at the closing position normally by resilient biasing means to force the guide member in engagement with the driver guide. Although the closing position can be reliably held by increasing the biasing force of the resilient biasing means, it becomes difficult to manually move the guide member against the biasing force and therefore, the guide member must be operated by using an appropriate tool.

SUMMARY OF THE INVENTION

It is, accordingly, an object of the present invention to provide a mechanism including a movable member which can be moved to open a fastener drive track formed in a driver guide of a fastener driving device and which can be moved to close the same while the manual operation of the movable member can be appropriately prevented according to driving operation of a driver.

It is another object of the present invention to provide a mechanism including a movable member which can be easily operated to open or close a fastener drive track formed in a driver guide of a fastener driving device.

According to the present invention, there is provided a mechanism for removing a jammed fastener from a fastener drive track formed in a driver guide of a fastener driving device through an opening formed in the fastener drive track, the fastener driving device including a driver reciprocally driven by a driving source to drive fasteners fed into the fastener drive track, comprising:

a movable member for closing the opening of the fastener drive track;

a connector mechanism for connecting the movable member to the driver guide in such a manner that the movable member is movable relative to the driver guide between a first position for closing the opening and a second position for opening the opening;

an engaging mechanism for engaging the movable member with the driver guide so as to keep the movable member at the first position; and a first biasing mechanism for biasing the movable member in a direction to engage the same with the driver guide, the first biasing mechanism applying a biasing force to the movable member when the driver is driven by the driving source, and the first biasing mechanism being prevented from applying the biasing force to the movable member when the driver is not driven.

The invention will become more fully apparent from the claims and the description as it proceeds in connection with the drawings.

DETAILED DESCRIPTION OF THE PREFERRED EMBODIMENT

Figure 1:
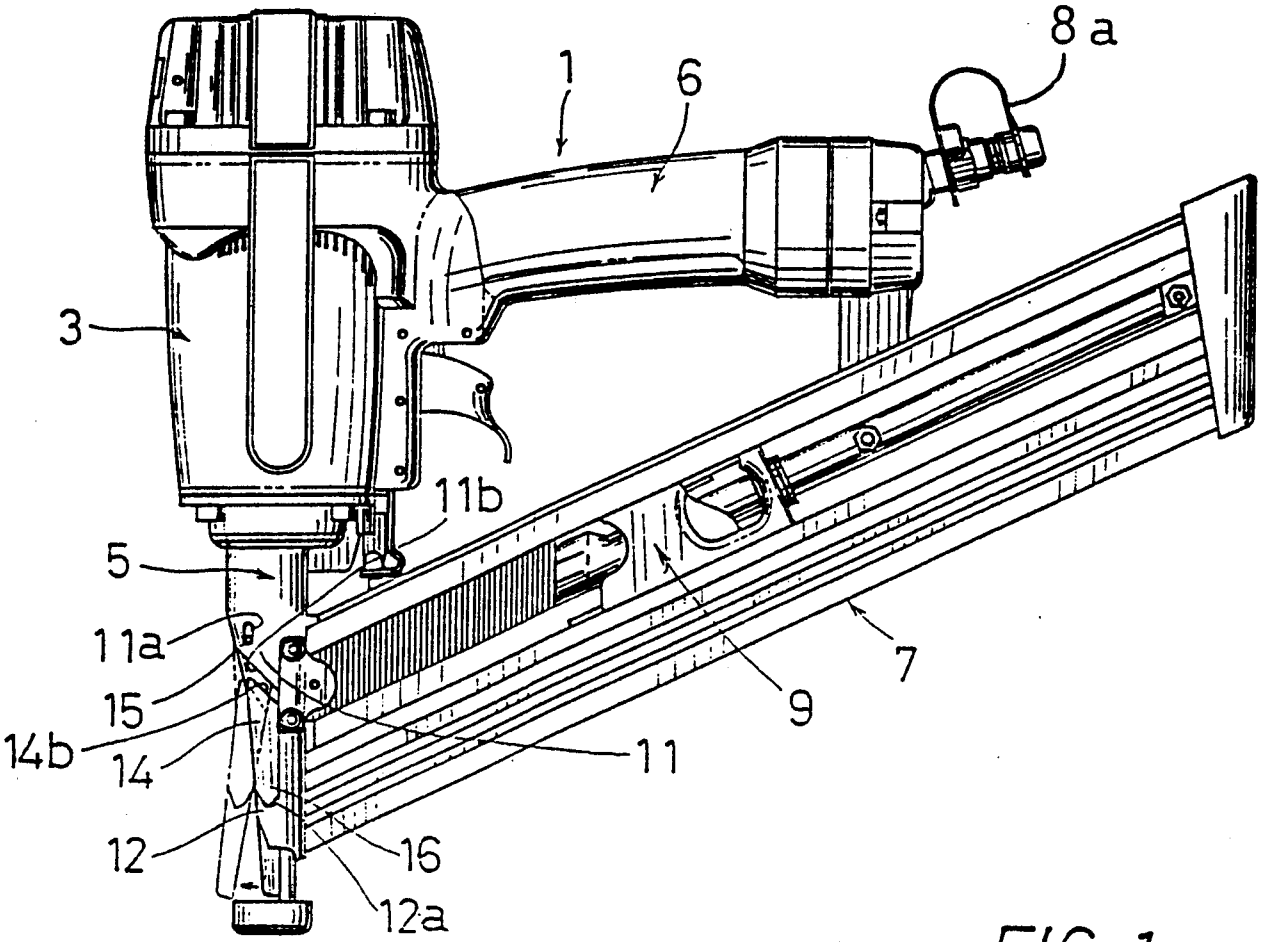
FIG. 1 is a side view of a fastener driving device including a mechanism for removing a jammed fastener according to an embodiment of the present invention.
Figure 2:
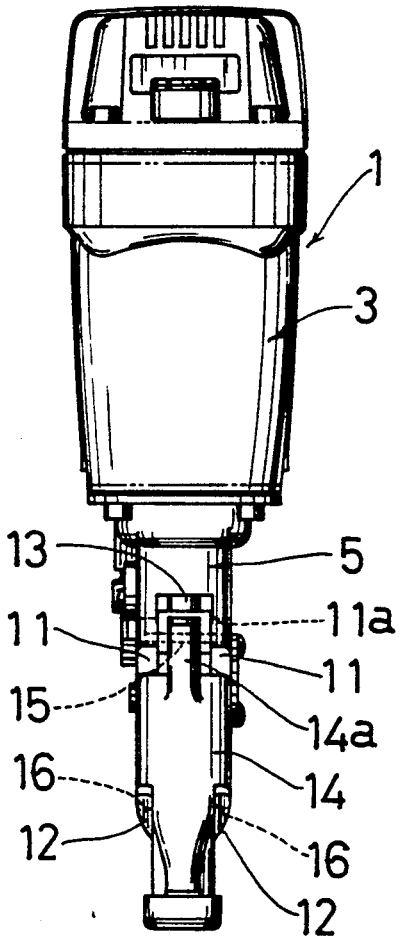
FIG. 2 is a front view of FIG. 1.

Referring to FIG. 1, there is shown a side view of a fastener driving device 1 including a mechanism for removing a jammed fastener according to an embodiment of the present invention. The fastener driving device 1 includes a body 3 having therein a piston (not shown) which is driven by compressed air supplied from an air source (not shown). A driver 2 is connected with the piston and is reciprocally moved by the piston within a fastener drive track 4 formed in a driver guide 5 which is mounted on a lower portion of the body 1. With the reciprocal movement, the driver 2 ejects fasteners T fed into the fastener guide track 4 one after another. A handle 6 is integrally formed with the body 3 and extends laterally in a direction substantially perpendicular to the longitudinal direction of the body 3. A magazine 7 is connected between the driver guide 5 and the handle 6 and extends obliquely relative thereto.

Figure 3:
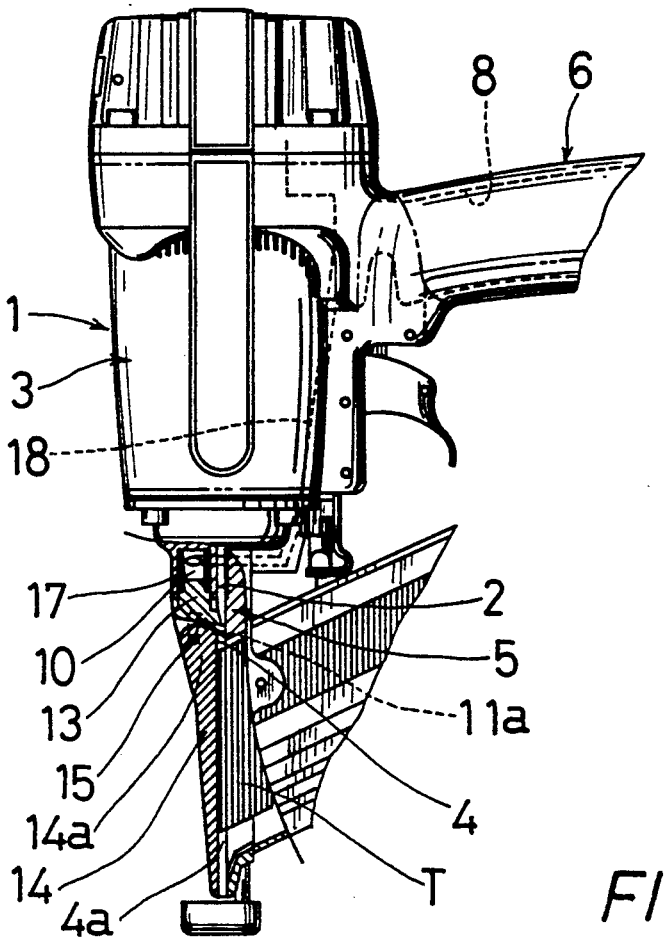
FIG. 3 is a side view of the main part of the fastener driving device with the mechanism for removing the jammed fastener shown in sectional view.

As shown in FIG. 3, the handle 6 includes therein an air chamber 8 for storing the compressed air supplied from the air source. A quick-connect coupler 8*a* shown in FIG. 1 serves to quickly connect and disconnect the air supply to the fastener driving device. The fasteners T to be driven are stored to the magazine 7 and are connected in a row by a predetermined number. A fastener feeder 9 is mounted on the magazine 7 for biasing the two of the fasteners T toward the driver guide 5 so as to feed them into the fastener drive track 4 one after another. Although the fastener T shown in the drawings are nails having relatively thin diameters, nails having ordinary diameters or U-shaped staples are also applicable.

The fastener drive track 4 of the driver guide 5 has an opening 4*a* of its front side. An operation cylinder 10 having relatively small diameter is formed at the upper portion of the driver guide 5. The cylinder 10 is disposed at the front side of the fastener drive track 4 adjacent thereto and extends parallel with the fastener drive track 4. The pair of first extensions 11 are formed integrally with the driver guide 5 and are disposed on both sides of the fastener drive track 4. The first extensions 11 extend downwardly from the cylinder 10 to a middle position of the driver guide 5 in the longitudinal direction. A pair of second extensions 12 are integrally formed wit the lower portion of the driver guide 5 and are disposed on both sides of the fastener drive track 4. An operational piston rod 13 having a fork-like lower portion is slidably inserted into the operational cylinder 10. Each of the first extensions 11 includes a front surface 11*b* inclined upwardly in a forward direction. Each of the second extensions 11 includes at its upper portion a V-shaped engaging surface 12*a* which is opened upwardly.

A flat plate-like movable member 14 is disposed on the front side of the driver guide 5 so as to close the opening 4*a* of the fastener drive track 4. The movable member 14 has a width which becomes shallower in a downward direction. The central portion of the inner surface of the movable member 14 forms a part of the fastener drive track 4. Further, the movable member 14 includes an expanded portion 14*a* at its upper end. The expanded portion 14*a* is slidably engaged between the fork-like lower portion of the operational rod 13. A pin 15 is mounted on the expanded portion 14*a*. Each end of the pin 15 engages an elongated slot 11*a* formed on each of the first extensions 11 in a vertical direction. The movable member 14 is thus pivotable and is vertically movable relative to the driver guide 5. Further, the movable member 14 includes a pair of oblique surfaces 14*b* formed on both sides of the upper portion of the movable member 14. The oblique surfaces 14*b* extend in parallel with the oblique surfaces 11*b* of the first extensions 11 and are opposed thereto when the movable member 14 is at a closing position as shown in FIG. 1. Additionally, the movable member 14 includes a pair of stepped portions on both sides of form V-shaped protrusions 16 for engagement with the engaging surfaces 12*a* of the second extension 12, respectively. Thus, the movable member 14 closes the opening 4*a*of the fastener drive track 4 when the protrusions 16 engage their corresponding engaging surfaces 12*a*. The movable member 14 opens the opening 4*a* when the protrusions 16 are disengaged from their corresponding engaging surfaces 12 *a* and are pivoted outwardly around the pin 15. In this manner, the protrusion 16 and engaging surfaces 12*a* cooperate to form a latch while controls the opening and closing of the movable member. In this embodiment, although the inclination angle of the protrusions 16 and the engaging surfaces 12*a* can be selectively determined relative to the longitudinal direction of the driver guide 5, such inclination angle is preferably determined to be about 30°.

A compression spring 17 is disposed within the operational cylinder 10 to bias the operational rod 13 downwardly. An air supply channel 18 connects the interior of the operational cylinder 10 to the air chamber 8 formed within the handle 6. With this construction, when the compressed air is supplied to the air chamber 8 of the handle 6, the operational rod 13 of the operation cylinder 10 receives the downward biasing force by the compressed air in addition to the biasing force of the spring 17, and it extends downwardly to force the movable member 14 in such a manner that the protrusion 16 forcibly engage their corresponding engaging surfaces 12*a* of the extension 12. When the compressed air is not supplied to the air chamber 8 of the handle 6, the biasing force by the operational rod 13 through the compressed air is not applied to the movable member 14. The biasing force by the operational rod 13 is determined as follows:

(a) When the compressed air is not supplied to the operational cylinder 10, or when the operational rod 13 is forced only by the spring 17, the movable member 14 can be moved upwardly by a manual force of an operator and can be pivoted to open the opening 4*a* of the fastener drive track 4.

(b) When the compressed air is supplied to the operational cylinder 10, or when the operational rod 13 is forced by the compressed air in addition to the spring 17, the movable member 14 cannot be moved upwardly by a manual force of the operator but can be moved upwardly by a strong force which may be produced when the fastener T has been jammed within the fastener drive track 4 during driving operation.

The operation of the above embodiment will now be explained.

The opening 4*a* is normally closed by the movable member 14 through engagement of the protrusions 16 with the engaging surfaces 12 *a* of the driver guide 5. When the compressed air is supplied to the air chamber 8 of the handle 6, the movable member 14 is biased to maintain engagement between the protrusions 16 and the engaging surfaces 12*a* through the biasing force of the spring 17 in addition to the compressed air as described above. With this situation, the fastener driving device 1 is operated to actuate the piston by the compressed air, so that the fasteners T fed into the fastener drive track 4 can be driven one after another by the driver 2.

Figure 4:
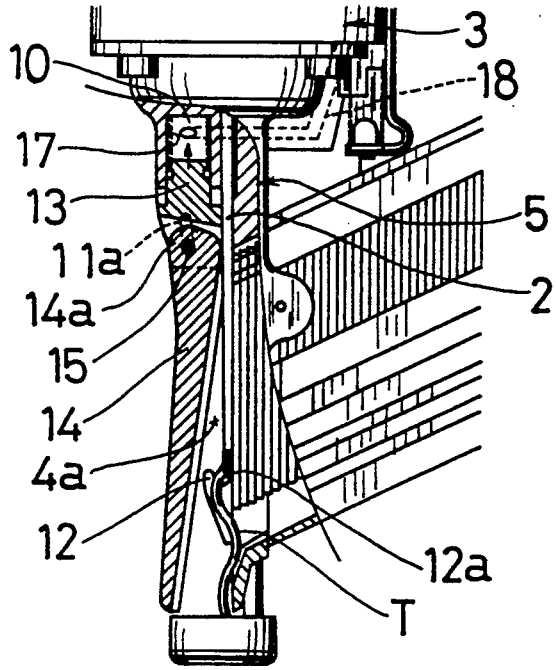
FIG. 4 is a view showing operation of the mechanism for removing the jammed fastener.

In case the fastener T has not been driven in a normal manner, the fastener T may be deformed or bent within the fastener drive track 4 and is jammed therewithin. As the fastener T is thus deformed, it may be pressed on the fastener drive track 4 by a strong force, so that the movable member 14 forming a part of the fastener drive track 4 is pressed by such a strong force. If the force exceeds the engaging force between the protrusions 16 and the engaging surfaces 12*a*, the movable member 14 is moved upwardly according to movement of the protrusions 16 along the engaging surfaces 12*a*. Thus, the movable member 14 is moved upwardly under the guide of the elongated slots 11*a* engaged with the pin 15 and is pivoted around the pin 15 in a clockwise direction so as to open the opening 4*a* as shown in FIG. 4. In other words, if the fastener T has not been normally driven and has been jammed within the fastener drive track 4, the movable member 14 is positively pivoted by the force of the jammed fastener T to open the opening 4*a*, so that the jammed fastener T can be removed from the opening 4*a*.

If the force of the jammed fastener T does not exceed the engaging force between the protrusions 16 and the engaging surfaces 12a produced by the compressed air in addition to the spring 17, the movable member 14 may not be moved to open the opening 4a. However, by stopping supply of the compressed air to the fastener driving device 1 or by stopping supply of the compressed air to the operational cylinder 10, the biasing force by the compressed air is no more applied to the operational rod 13. At this stage, the movable member 14 can be manually moved upwardly against the force of the spring 17 for disengaging the protrusions 16a from the engaging surfaces 12a. Thus, the movable member 14 can be pivoted for removing the jammed fastener T through the opening 4a.

With regard to the returning operation of the movable member 14 with the opening position to the closing position, if the compressed air is supplied to the operational cylinder 1, the movable member 14 cannot be moved upwardly for engaging the protrusions 16 with the engaging surfaces 12a because of the presence of the biasing force produced by the compressed air within the cylinder 10. Then the operator operates the fastener driving device 1 for stopping supply of the compressed air to the air chamber 8 or stopping supply of the compressed air to the operational cylinder 10. The biasing force by the compressed air is thus no more applied to the operational rod 13, so that the movable member 14 can be manually moved upwardly against the force of the spring 17 and can be pivoted in a counterclockwise direction in FIG. 4 for engagement of the protrusions 16 with the engaging surfaces 12a. After the protrusions 16 have been engaged with the engaging surfaces 12a, such engagement is kept by the biasing force of the spring 17, and therefore, the fastener driving device 1 can be operated to drive the fasteners T.

As described above, the biasing force of the spring 17 is determined to permit manual operation of the movable member 14 and such biasing force may have a relatively small value since the biasing force by the compressed air is applied to the movable member 14 in addition to the biasing force of the spring 17 during driving operation of the fastener driving device 1. Therefore, the operation of the movable member 14 for opening and closing the opening 4a of the fastener drive track 5 can be easily made without using a tool.

Further, the operation of the movable member 14 to return the closing position cannot be made unless the supply of the compressed air to the fastener driving device 1 has been stopped. Therefore, the fasteners T may not be driven until the opening 4a of the fastener drive track 5 has been closed by the movable member 14 after the supply of the compressed air has been stopped. Additionally, in case that it is necessary to move the movable member 14 from the closing position to the opening position or vice versa for any other reason, such operation cannot be made unless the supply of the compressed air is once stopped. This means that such operation of the movable member 14 is performed with the driver 2 being not driven.

In the above embodiment, the biasing force of the movable member 14 applied in addition to the force of the spring 17 is produced by the compressed air which has been supplied from the air chamber 8 to the operational cylinder 10 for moving the operational rod 13. However, such additional basing force may be produced by any other means which can be operated by any other driving source of the fastener driving device 1.

While the invention has been described with reference to a preferred embodiment, it is to be understood that modifications or variations may be easily made without departing from the spirit of this invention which si defined by the appended claims.

What is claimed is:

1. A mechanism for removing a jammed fastener from a fastener drive track formed in a driver guide of a fluid pressure operated fastener driving device through an opening force in the fastener drive track, the fastener driving device including a driver reciprocally driven by a driving source to drive fasteners fed into the fastener drive track, comprising:

a movable member for closing the opening of the fastener drive track;

connecting means for connecting said movable member to the driver guide in such a manner that said movable member is movable relative to the driver guide between a first position for closing the opening and a second position for opening the opening;

latch means for latching said movable member to said driver guide so as to keep said movable member at said first position; and first biasing means for biasing said movable member in a direction to latch said movable member with said driver guide, said first biasing means applying a biasing force to said movable member when the fastener driving device is connected to an external source of fluid pressure, and said first biasing means being prevented from applying the biasing force to said movable member when the fastener driving device is disconnected from said external source of fluid pressure; and wherein said movable member has first and second end portions in a longitudinal direction of the driver guide; said connecting means connecting said first end portion of said movable member to the driver guide in such a manner that said movable member is pivotable relative to the driver guide and is movable in the longitudinal direction relative to the driver guide by a predetermined distance; said latch means including at lest one protrusion formed on said second end portion of said movable member, and a recess formed on said driver guide for engagement with said protrusion; and said protrusion and said recess being engageable with each other in the longitudinal direction of the driver guide.

2. The mechanism as defined in claim 1 wherein said connecting means includes a pin mounted on said first end portion of said movable member and an elongated slot formed on the driver guide.

3. The mechanisms as defined in claim 1 wherein said first biasing means includes a cylinder formed adjacent the fastener drive track of the driver guide and a piston slidably movable within said cylinder; said cylinder receiving a part of the fluid pressure supplied from the external source of fluid pressure; and said piston is drivingly linked to said first end portion of said movable member substantially in the longitudinal direction of the driver guide.

4. The mechanism as defined in claim 1 further including second biasing means for normally biasing said movable member in a direction for engagement of said latch means; the biasing force of said second biasing means being determined in such a manner that said movable member can be manually moved from said first position to said second position against the biasing force of said second biasing means through said connecting means so as to disengage said latch means.

5. The mechanisms as defined in claim 4 wherein said first biasing means includes a cylinder formed adjacent the fastener drive track of the driver guide and a piston slidably movable within said cylinder; said cylinder receiving a part of the fluid pressure supplied from the external source of fluid pressure; and said piston is drivingly linked to said first end portion of said movable member substantially in the longitudinal direction of the driver guide; and wherein said second biasing means is a compression spring disposed within said cylinder to bias said piston toward said first end portion of said movable member.

6. A mechanism for removing a jammed fastener from a fastener drive track formed in a driver guide of a fluid pressure operated fastener driving device through an opening formed in the fastener drive track, the fastener driving device including a driver reciprocally driven by a driving source to drive fasteners fed into the fastener drive track, comprising:

a movable member for closing the opening of the fastener drive track;

connecting means for connecting said movable member to the driver guide in such a manner that said movable member is movable relative to the driver guide between a first position for closing the opening and a second position for opening the opening;

latch means for latching said movable member to said driver guide so as to keep said movable member at said first position; and first biasing means for biasing said movable member in a direction to latch said movable member with said driver guide, said first biasing means applying a biasing force to said movable member when the fastener driving device is connected to an external source of fluid pressure, and said first biasing means being prevented from applying the biasing force to said movable member when the fastener driving device is disconnected from said external source of fluid pressure; and wherein said latch means comprises interengaging cam surfaces forced to slide with respect to each other to a release position by the lateral pressure of a jammed fastener in the drive track whereby said movable member is forced to said second open position against the bias of said first biasing means.

7. The mechanisms of claim 6 wherein the fastener driving device can be reset to operating position after removal of the jammed fastener by disconnecting the external source of fluid pressure and manually resetting the movable member and latch means to said first closed position and then reconnecting the source of pressure.

8. A mechanism for removing a jammed fastener from a fastener drive track formed in a driver guide of a fluid pressure operated fastener driving device through an opening formed in the fastener drive track, the fastener driving device including a driver reciprocally driven by a driving source to drive fasteners fed into the fastener drive track, comprising:

a movable member for closing the opening of the fastener drive track;

connecting means for connecting said movable member to the driver guide in such a manner that said movable member is movable relative to the driver guide between a first position for closing the opening and a second position for opening the opening;

latch means for latching said movable member to said driver guide so as to keep said movable member at said first position; and first biasing means for biasing said movable member in a direction to latch said movable member with said driver guide, said first biasing means applying a biasing force to said movable member when the fastener driving device is connected to an external source of fluid pressure, and said first biasing means being prevented from applying the biasing force to said movable member when the fastener driving device is disconnected from said external source of fluid pressure; and wherein said latch means comprises interengaging cam surfaces comprised of a pair of V-shaped protrusions on a lower portion of said movable member mating with a pair of V-shaped engaging surfaces on said driver guide.

9. A mechanism for removing a jammed fastener from a fastener drive track formed in a driver guide of a fluid pressure operated fastener driving device through an opening formed in the fastener drive track, the fastener driving device including a driver reciprocally driven by a driving source to drive fasteners fed into the fastener drive track, comprising:

a movable member for closing the opening of the fastener drive track;

connecting means for connecting said movable member to the driver guide in such a manner that said movable member is movable relative to the driver guide between a first position for closing the opening and a second position for opening the opening;

latch means for latching said movable member to said driver guide so as to keep said movable member at said first position; and first biasing means for biasing said movable member in a direction to latch said movable member with said driver guide, said first biasing means applying a biasing force to said movable member when the fastener driving device is connected to an external source of fluid pressure, and said first biasing means being prevented from applying the biasing force to said movable member when the fastener driving device is disconnected from said external source of fluid pressure; and wherein said latch means comprises interengaging cam surfaces forming an angle of about 30 degrees.

* * * * *